US011214397B2

(12) United States Patent
Wilson et al.

(10) Patent No.: US 11,214,397 B2
(45) Date of Patent: Jan. 4, 2022

(54) MACHINE DIRECTION, TRANSVERSE DIRECTION AND ANGLED PRE-APPLIED ZIPPERS IN THE ANGLED AND TRANSVERSE DIRECTION

(71) Applicant: Illinois Tool Works Inc., Glenview, IL (US)

(72) Inventors: Leslie Wilson, Schnecksville, PA (US); W. Brandt Nako, Loveland, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 664 days.

(21) Appl. No.: 14/195,407

(22) Filed: Mar. 3, 2014

(65) Prior Publication Data

US 2014/0315702 A1 Oct. 23, 2014

Related U.S. Application Data

(60) Provisional application No. 61/811,938, filed on Apr. 15, 2013.

(51) Int. Cl.
*B31B 70/00* (2017.01)
*B65B 61/18* (2006.01)

(52) U.S. Cl.
CPC ..... *B65B 61/188* (2013.01)

(58) Field of Classification Search
CPC . B31B 19/90; B31B 19/84; B31B 2219/9067; B31B 70/004; B31B 70/813; B31B 70/8131; B31B 70/8132; B31B 70/8133; B65B 61/188
USPC ..... 493/213
See application file for complete search history.

(56) References Cited

U.S. PATENT DOCUMENTS 4,240,241 A 12/1980 Sanborn
4,335,817 A * 6/1982 Bahr ..... B65D 33/25 206/260
4,682,366 A * 7/1987 Ausnit ..... B65D 33/2533 156/66
5,470,156 A * 11/1995 May ..... B65D 33/18 383/210
5,823,933 A * 10/1998 Yeager ..... B65B 61/188 493/213
5,964,532 A * 10/1999 St. Phillips ..... B65D 33/2525 383/203
6,138,439 A * 10/2000 McMahon ..... B65B 9/04 53/133.4
6,212,857 B1 * 4/2001 Van Erden ..... B65B 61/188 156/66
6,428,642 B1 * 8/2002 Matthews ..... B65B 9/20 156/218
6,843,038 B1 * 1/2005 Haws ..... B65B 9/04 226/195
6,991,372 B2 * 1/2006 Cornelisse ..... B65D 33/2591 383/203
7,172,545 B2 * 2/2007 Howell ..... B65B 9/20 493/213

(Continued)

*Primary Examiner* — Sameh Tawfik
(74) *Attorney, Agent, or Firm* — McCarter & English, LLP

(57) ABSTRACT

The present disclosure relates to a method, apparatus and product in the art of reclosable packaging wherein the zipper is sealed to a film structure prior to treatment by the packaging machine for producing a thermoformed package. The zipper can be oriented in the machine direction, the transverse direction or at an angled orientation.

10 Claims, 8 Drawing Sheets

(56) References Cited

U.S. PATENT DOCUMENTS

| | | | | |
|---|---|---|---|---|
| 7,325,378 | B2 * | 2/2008 | Ausnit | B65B 9/023 493/213 |
| 7,340,870 | B2 * | 3/2008 | Roger | B31B 19/90 493/213 |
| 7,341,160 | B2 * | 3/2008 | Cappel | B65D 33/2591 206/461 |
| 7,481,580 | B2 * | 1/2009 | Schreiter | B65D 33/2591 383/203 |
| 7,673,437 | B2 * | 3/2010 | Schneider | B65D 33/2591 53/139.2 |
| 8,506,745 | B2 * | 8/2013 | Wright | B29C 65/18 156/209 |
| 2002/0184858 | A1 | 12/2002 | Ausnit | |
| 2003/0177738 | A1 * | 9/2003 | Plourde | B65B 61/188 53/412 |
| 2003/0202717 | A1 * | 10/2003 | Schneider | B65B 9/045 383/5 |
| 2003/0202720 | A1 * | 10/2003 | VandenHeuvel | B65D 33/007 383/204 |
| 2003/0219173 | A1 * | 11/2003 | Schneider | B65B 9/20 383/9 |

* cited by examiner

MACHINE DIRECTION, TRANSVERSE DIRECTION AND ANGLED PRE-APPLIED ZIPPERS IN THE ANGLED AND TRANSVERSE DIRECTION

BACKGROUND OF THE DISCLOSURE

This application claims priority under 35 U.S.C. 119(e) of U.S. provisional application Ser. No. 61/811,938, filed on Apr. 15, 2013, the disclosure of which is hereby incorporated by reference in its entirety.

FIELD OF THE DISCLOSURE

The present disclosure relates to a method, apparatus and product wherein the zipper of a reclosable thermoform package is sealed to a film structure prior to treatment by the packaging machine. The zipper can be oriented in the machine direction, the transverse direction or at an angled orientation.

DESCRIPTION OF THE PRIOR ART

With respect to zippered reclosable packages, current pre-applied zipper applications are available in the transverse film direction, specifically to run on vertical form fill seal (VFFS) or overwrap machines. This may be achieved through the Innolok® process. There are also current applications for manufacturers to run zipper and film, separately, in the transverse direction on vertical form fill seal and overwrap machines.

Manufacturers who want to supply their customers with packages with reclosable technology have the option to purchase equipment that has reclosable technology or to use equipment that does not have the capability to run zipper. Applications for having zipper in the machine or film direction on packages are currently limited to running film and zipper separately. This requires manufacturers who want a package with reclosable features to purchase or refit their packaging machine in order to run film and zipper. This is a costly choice for manufacturers who want to supply their customers with a reclosable package. Supplying a technology that will enable a film to have a pre-applied zipper will open opportunities to many manufacturers who would like to incorporate reclosable technology in their package, but for whatever reason, cannot purchase new equipment or retrofit existing equipment to achieve a resealable or reclosable package.

Prior art includes U.S. Pat. No. 4,896,775 entitled "Zipper Thermal Form Tray System"; U.S. Pat. No. 4,949,527 entitled "Method of Forming a Reclosable Tray"; U.S. Pat. No. 6,941,726 entitled "Method and Apparatus for Makin; Reclosable Packages Having Slider-Actuated Siang Zippers"; U.S. Pat. No. 6,820,394 "Method for Forming Zippered Thermoformed Packages"; U.S. Pat. No. 7,302,782 entitled "Method and Apparatus for Making Reclosable Packages 1-laying Slider-Actuated String Zippers" and U.S. Pat. No. 7,325,378 entitled "Vertical Form Fill and Seal Method for Producing Reclosable Packages from Two Sheets of Web".

OBJECTS AND SUMMARY OF THE DISCLOSURE

It is therefore an object of the present disclosure to provide a method, apparatus and product wherein the zipper is sealed to a film structure prior to treatment by the packaging machine. This can be done in the machine direction, the transverse direction or at an angled orientation. This is particular applicable to thermoform applications.

These and other objects are obtained by taking an existing zipper (such as, but not limited to a slider zipper or a zipper with a pre-activated peel seal) and sealing it to a film structure in the machine direction (also known as the film unwind direction) prior to the packaging machine. In the case of a thermoform machine, the zipper would be placed either on the non-forming film or the forming film inside of the machine-made seals, in the machine direction, typically configured so that the zipper is attached to the forming film which forms the top of the package. The only part of the zipper that would be sealed to the forming film (in the case of the zipper being pre-sealed onto the non-forming film) would be at the ends of the package (cross seal bars) and vice versa for the zipper being sealed onto the forming film. For the thermoform package, there may be several zippers being presealed if the machine was a two, three or four-up machine. On a vertical, horizontal or overwrap form film seal machine, the zipper would be sealed to the film prior to the packaging machine in the machine or film direction.

Further, these and other advantages are obtained in that the zipper segments typically need to be attached to only one web on a two-web packaging system, such as a TFFS (transverse or thermoform form fill seal) system with a forming web and a separate lidding web. Further, in some embodiments of this disclosure, there are discrete zipper segments which can be made short enough that they do not extend into the cross-seals thereby greatly reducing the likelihood of leaks, which can be critical for TFFS packages which are typically modified atmosphere packages containing easily spoiled products.

Likewise, these and other advantages are obtained by taking a similar zipper and sealing it to the forming or non-forming web of a thermoform machine in a transverse or angled direction. The zipper applied to the forming film in either the transverse or angled direction would be applied to the material at the bottom of the pocket area and the package/tooling would have to be designed to have minimal distortion and heat applied to the zipper area. Multiple applicators and spools could be employed to accommodate multiple lane thermoform machines.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 2:
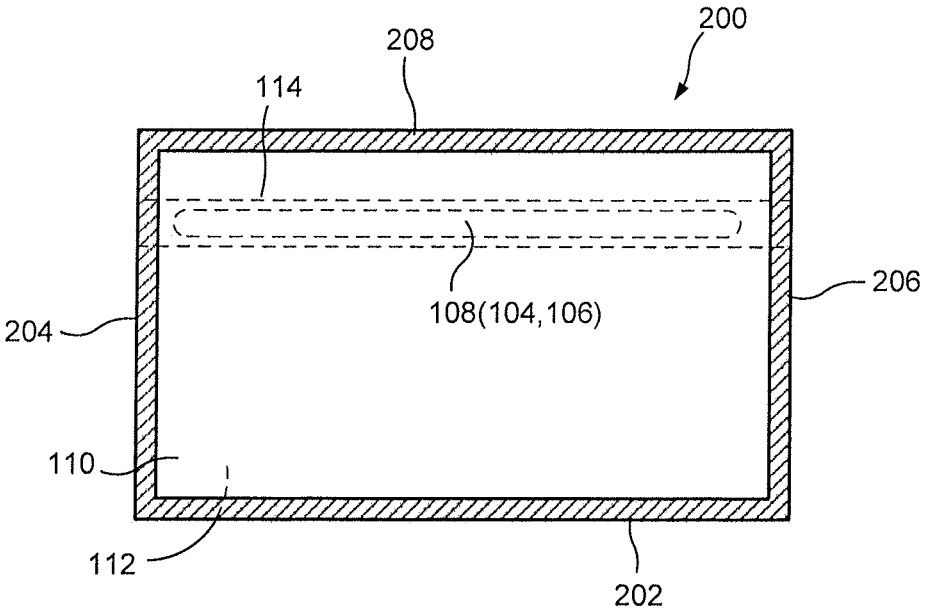
FIG. 2 is a top view of a typical thermoformed package made from the film of FIG. 1.
Figure 1:
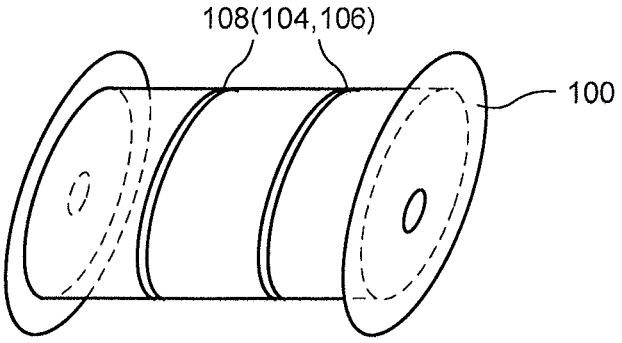
FIG. 1 is a perspective view of a spool of film with a double zipper applied in the machine direction.

Referring now to the drawings in detail, wherein like numerals indicate like elements through the several views, one sees that FIG. 1 is a spool 100 of film or web 102, wherein the film or web 102 includes two pre-applied machine direction zippers 108 (pre-applied as a continuous length) thereby forming a double zipper, comprising zipper profiles 104, 106. One zipper profile 104 or 106 is attached to the film or web 102 and the other zipper profile 104, 106 is engaged or interlocked with the profile attached to the film or web 102. Film or web 102 is typically configured so that the zipper profiles 104, 106 are applied underneath the top film of a package with the opening flange facing upward against the film. The spool 100 of film or web 102 as illustrated in FIG. 1 is provided to a packaging machine (not shown). The spool 100 of film or web 102 may be manufactured at a location either local or remote from the packaging machine. The packaging machine typically takes film or web 102 along with another film or web (not shown) which does not include zipper components, and forms top and bottom walls 110, 112 (wherein bottom wall 112 may be thermoformed with a pocket structure), with the zipper profiles 104, 106 on the interior of the package 200, as illustrated in FIG. 2. The packaging machine forms first lengthwise seal 202, side seals 204, 206 and second lengthwise seal 208 between the two sheets of film or web 102 and one sheet of film thereby forming the rectangular shape of the package 200, wherein web 102 becomes the top wall of package 200. Additionally, in order to provide access to the zipper 108, lines of weakness 114 are formed in the film or web 102 above at least one of zipper profiles 104, 106 which form zipper 108 in top wall 110. The zipper 108 is in contact with the top wall 110, and not the bottom wall 112 or any of the seals between the top and bottom walls 110, 112. The lines of weakness 114 form an easy-open element which is engaged by the zipper 108. The easy-open element can be implemented in several ways which would be known to one skilled in the art, after review of the present disclosure, including, but not limited to, lines of weakness, perforations, score lines and adhesive patches.

Figure 9:
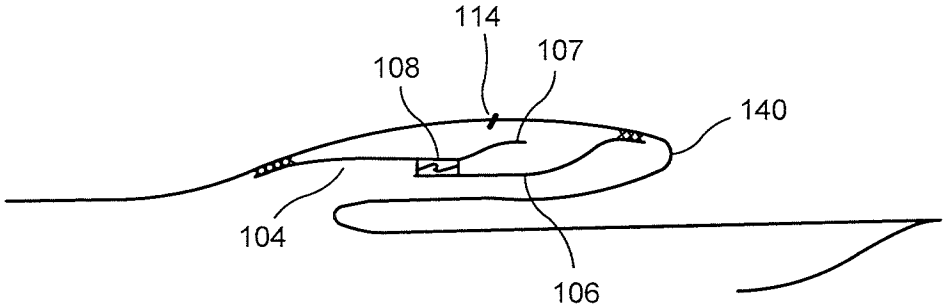
FIG. 9 illustrates a cross-sectional view of the zipper configuration in a tray-type embodiment of the present disclosure.

In tray-type embodiments, a cross-section such as is shown in FIG. 9, with a fold 140 behind the zipper 108, formed in the sealing flange of zipper 108 may be necessary for a user to get his or her fingers behind the interlocking tracks and press them together or otherwise operate them. In the lack of such a structure, the contents of the package may interfere with one being able to press together the interlocking zipper tracks. The width of the film (with attached transverse zippers) controls whether one or more packages are produced from it. The fold 140 may be positioned within the zipper 108 or within the top wall 110.

Figure 4:
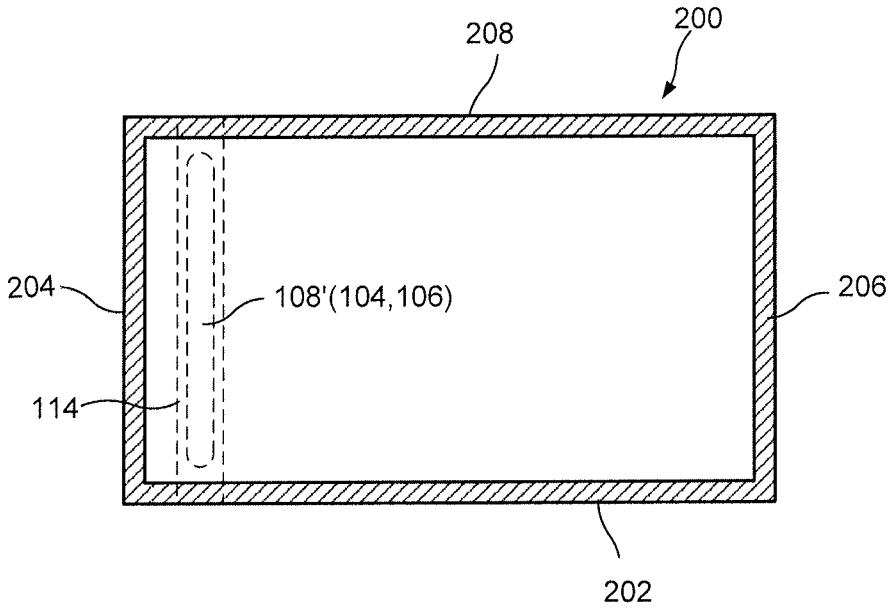
FIG. 4 is a top view of a typical thermoformed package made from the film of FIG. 3.

In more detail, in the embodiment of FIG. 4, which illustrates an exemplary single zipper web arrangement, if the packaging machine is a thermoform machine, the zipper 108 would be placed either on the non-forming film or the forming film inside of the machine-made seals, in the machine direction. The only part of the zipper 108 that would be sealed to the forming film (in the case of the zipper being pre-sealed onto the non-forming film) would be at the ends of the package (cross seal bars) and vice versa for the zipper being sealed onto the forming film. For the thermoform package, there may be several zippers being presealed if the machine was a two, three or four-up machine. On a vertical, horizontal or overwrap form film seal machine, the zipper 108 would be sealed to the film prior to the packaging machine in the machine or film direction. In most cases, the zipper 108 will be on the lid, non-forming web or top side of the package. However, in some cases the zipper 108 may be found on the forming side of the package.

Figure 3:
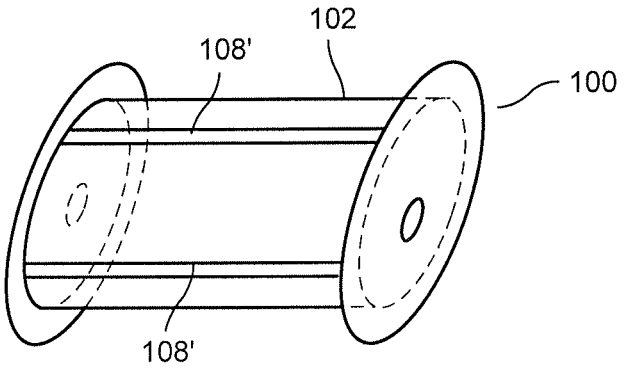
FIG. 3 is a perspective view of a spool of film with zipper applied in the transverse direction.

FIG. 3 discloses a second embodiment wherein spool 100 of film or web 102 is provided. Transverse machine direction zipper profiles 108' are attached periodically along the film or web 102, and are provided as a series of discrete lengths of zipper material. Typically, the transverse machine direction zipper profiles 108' are provided with zipper profiles 104, 106 in an interlocked configuration with one of the zipper profiles 104 or 106 sealed to the film or web 102. This film or web 102 is provided to the packaging machine (not shown) as one web in a two-web packaging system wherein as shown in FIG. 4, similar to the embodiment of FIG. 2, first lengthwise seal 202, side seals 204, 206 and second lengthwise seal 208 are formed thereby forming the rectangular shape of the package 200. The spool 100 of film or web 200 may be manufactured at a location either local or remote from the packaging machine. Additionally, in order to provide access to the zipper 108, lines of weakness 114 are formed in the film or web 102 above at least one of zipper profiles 104, 106 which form zipper 108', typically in front or top wall 110.

In more detail, in the embodiment of FIGS. 3 and 4, the zipper segments typically need to be attached to only one web on a two-web packaging system, such as a TFFS (transverse or thermoform form fill seal) system with a forming web and a separate lidding web. Further, in some embodiments of this disclosure, there are discrete zipper segments which can be made short enough that they do not extend into the cross-seals thereby greatly reducing the likelihood of leaks, which can be critical for TFFS packages which are typically modified atmosphere packages containing easily spoiled products.

Figure 5:
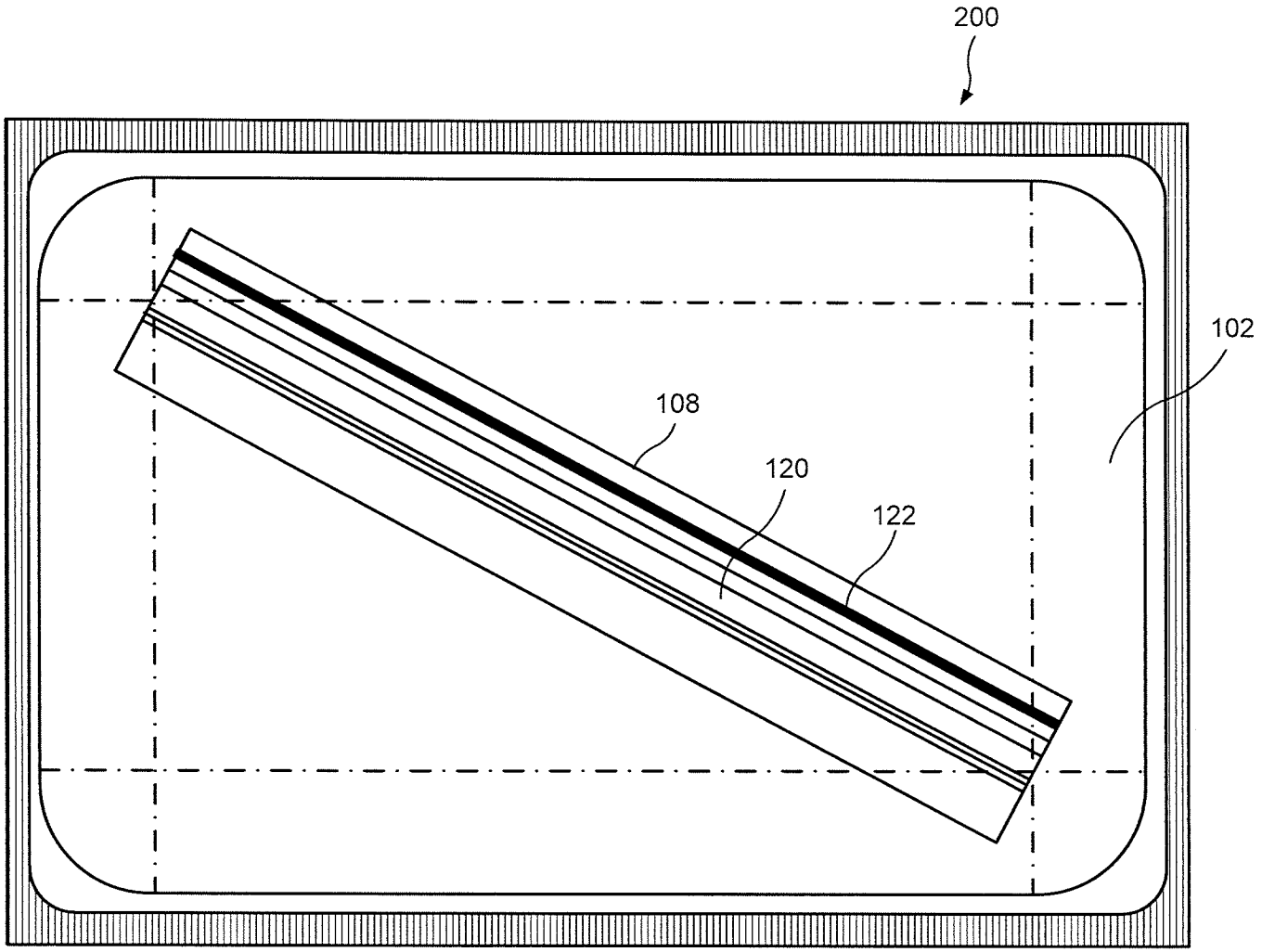
FIG. 5 is a plan view of a press-to-close zipper, diagonally directed on a forming or non-forming web.
Figure 6A:
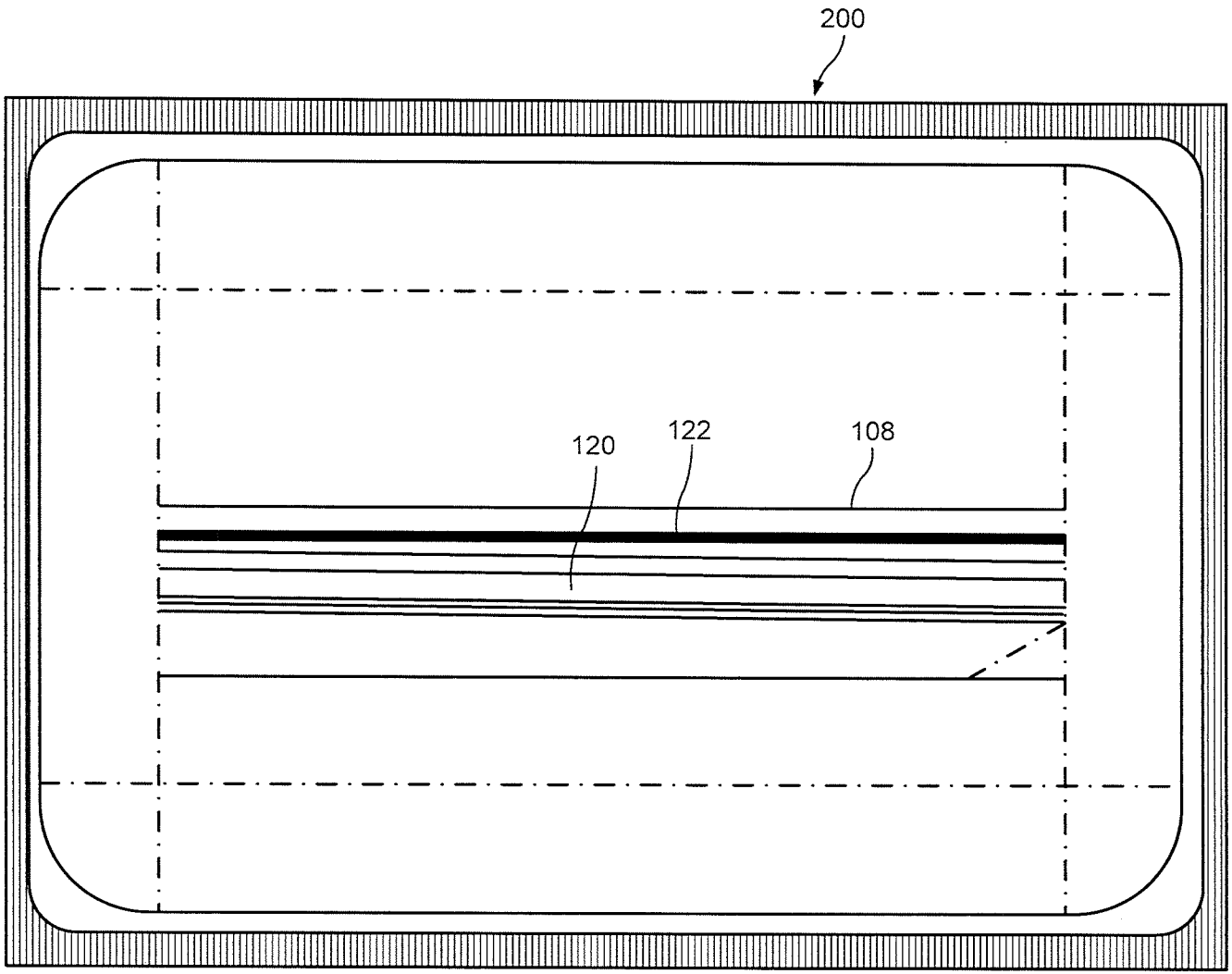
FIG. 6A is a plan view of a press-to-close zipper in a machine direction on a forming or non-forming web.
Figure 6B:
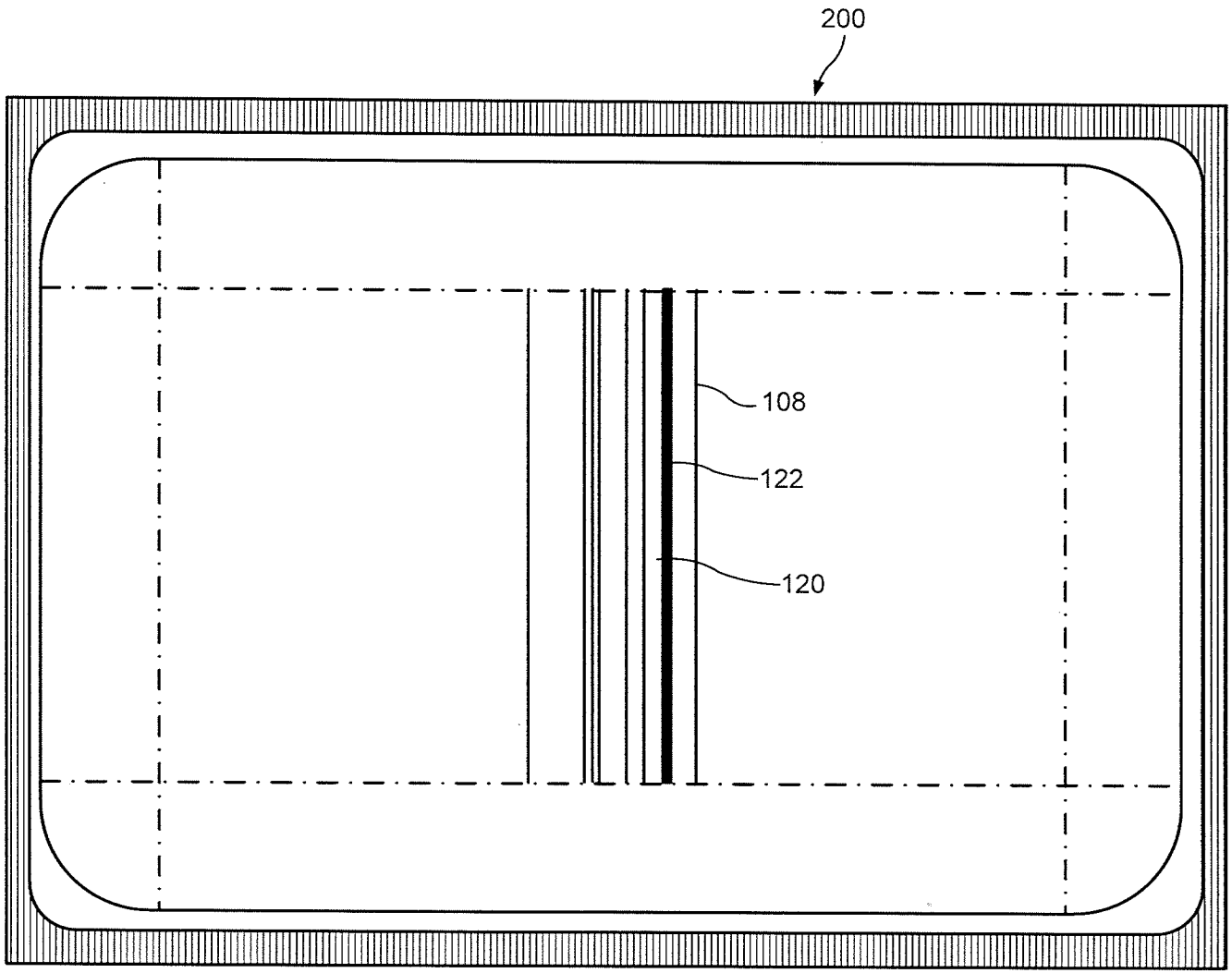
FIG. 6B is a plan view of a press-to-close zipper in a transverse direction on a forming or non-forming web.

FIGS. 5, 6A and 6B illustrate further embodiments of the package 200, which may be thermoformed. FIG. 5 illustrates an embodiment wherein the zipper 108 is placed in an angled orientation. The zipper 108 may be a press-to-close zipper, or some other style of zipper. The zipper 108 may further include peel seal 120, and may still further include a line 122 including a color, such as may be provided in a Color Line™ bag or product. FIG. 6A is a similar embodiment but with a zipper 108 of a machine orientation in the middle of the package, while FIG. 6B illustrates an embodiment with a zipper in a transverse orientation in the middle of the package. In FIGS. 5, 6A and 6B, the zipper 108 may be placed on the forming or non-forming web as provided to the packaging machine.

Figure 10:
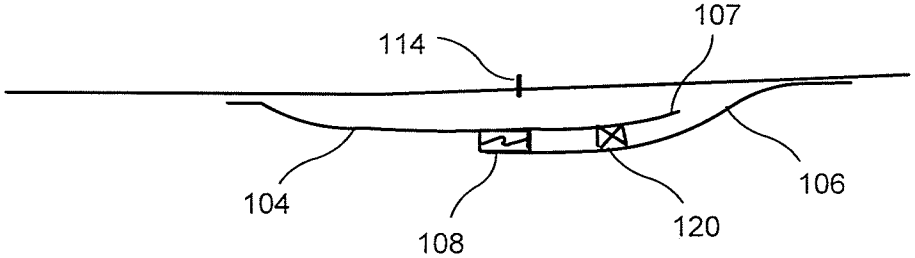
FIG. 10 illustrates a cross-sectional view of the embodiments of FIGS. 2, 4, 5 and 6.

FIGS. 9 and 10 are cross-sectional views of typical embodiments illustrated in FIGS. 2, 4, 5 and 6. In FIG. 9, the zipper 108 is formed within fold 140 behind the zipper 108 (formed in the sealing flange of zipper 108 which may be necessary for a user to get his or her fingers behind the zipper to operate the zipper). Zipper opening flange 107 is presented to the user after the user has opened line of weakness 114, thereby allowing the user to grasp the zipper opening flange 107 to open the zipper. FIG. 10 illustrates a similar configuration, including a peel seal 120 between the zipper opening flange 107 and the zipper 108, but without a fold 140, wherein closing the zipper does not interfere with the package contents. This configuration may be used for embodiments wherein reclosure is less important than with FIG. 9.

Figure 7:
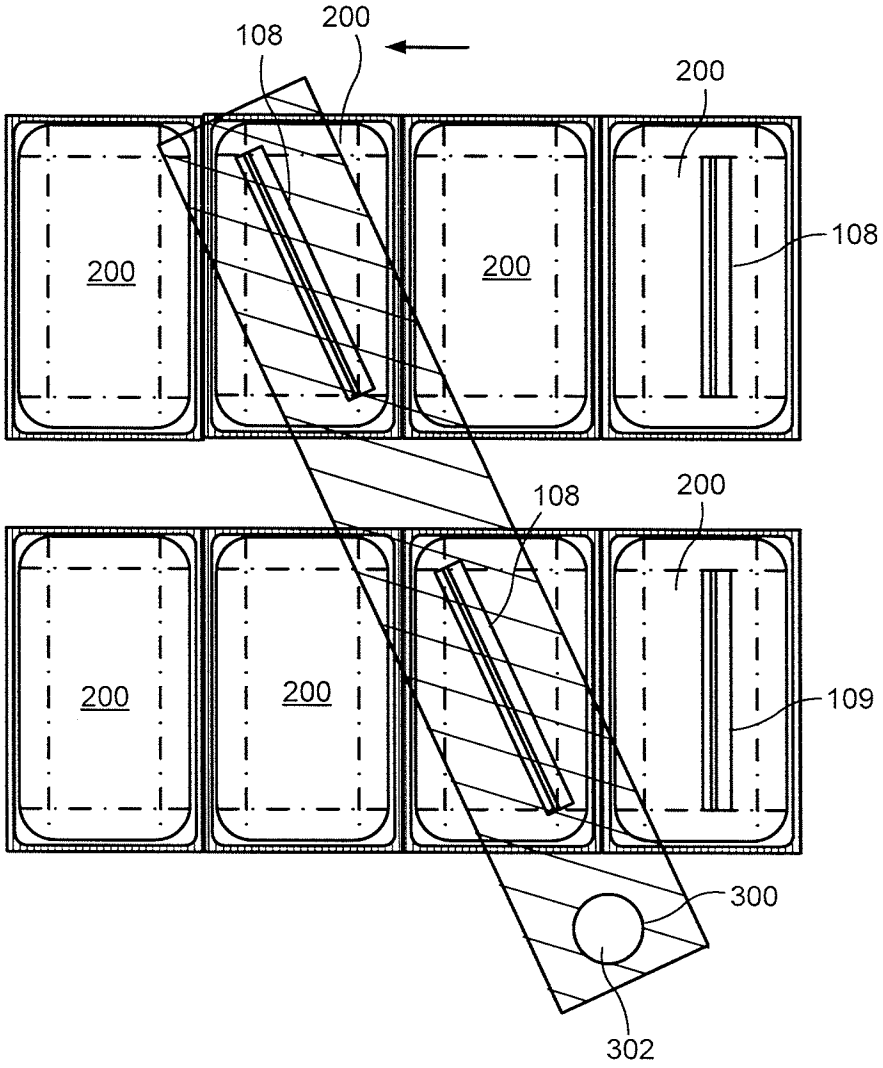
FIG. 7 is a plan view of a pivoted applicator arm, for applying zipper in a transverse or angled orientation.

As shown in FIG. 7, the packages of FIGS. 5 and 6 may be formed by providing multiple lanes of packages 200 with a zipper applicator 300 pivoting on point 302. With such a pivoting zipper applicator 300, the zippers 108 may be provided at a chosen angled orientation, such as illustrated in FIG. 5, a machine direction as illustrated in FIG. 6A, or at a transverse orientation as illustrated in FIG. 6B.

Figure 8A:
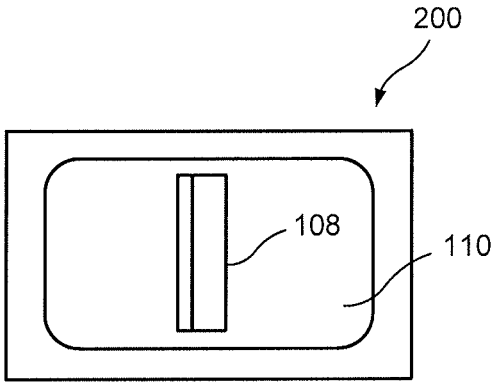
FIG. 8A illustrates a top plan view of the package of FIG. 6A.
Figure 8B:
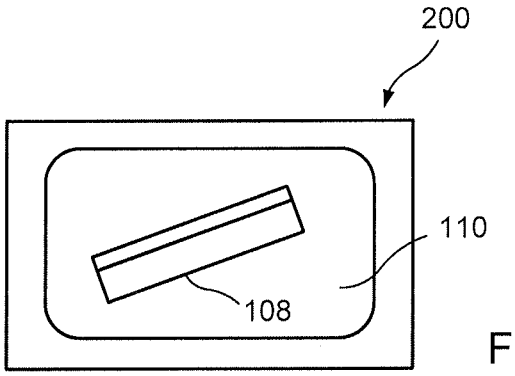
FIG. 8B illustrates a top plan view of the package of FIG. 5.

FIG. 8A illustrates a top (or bottom) plan view of the package 200 of FIG. 6A, while FIG. 8B illustrates a top (or bottom) plan view of the package 200 of FIG. 5.

Figure 11:
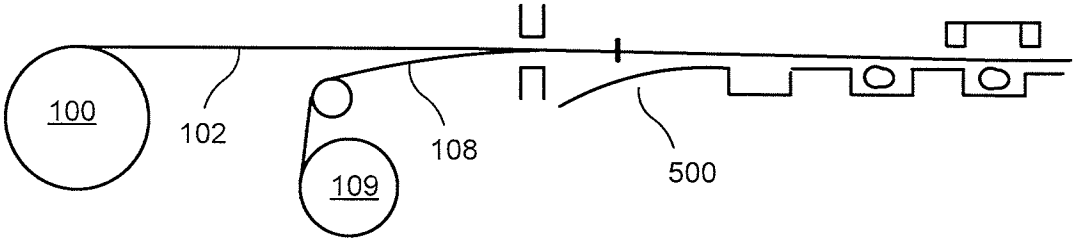
FIG. 11 illustrates a manufacturing process of embodiments of the present disclosure.

FIG. 11 illustrates a typical manufacturing process. Front film 102 is provided from spool 100. Zipper material 108 is provided from spool 109 and is sealed to the front film 102 material. Tray material 500 is provided. The pockets within tray material 500 are formed, loaded and then sealed with the front film 102, including the zipper material 108. The front film 102 can be supplied separately from the tray material 500.

In more detail, the zipper 108 is applied underneath the front film 102 with the separating flange (element 107, FIGS. 9 and 10) pointing upwardly. The zipper front film is then introduced to a packaging machine over a product loaded back film or tray and sealed thereto. Alternately, the zipper can be pre-applied to the film then spooled and then delivered to the packaging machine as a separate operation. Additionally, the film above the zipper typically has a weakened tear area that is removed to provide access to the zipper. Additionally, the zipper can be applied to the film in segments rather than continuously so that the zipper does not extend into the end seals.

The illustrated embodiments will typically achieve many of the following advantages:

1. Customers that have thermoform machines and want to produce a package with zipper would not have to buy or modify a new machine.

2. If a customer has a thermoform machine and wants to retrofit it to run zipper, the OEMs require that they ship the machine to the OEM location to perform the retrofit. For most of the small customers in the meat industry, this is not an option because it would remove their only packaging machine.

3. Pre-applied zipper in the machine direction would stimulate the meat industries in areas where the meat processors have only one machine.

4. A customer can get into the resealable market in much shorter time frame than waiting for a new machine or a retrofit. This will allow a manufacturer to differentiate them from the traditional zipper package.

5. There is less complexity to the manufacturer because they could run just film, rather than zipper and film. This will typically involve less scrap and changeover-related downtime than running a zipper in-line. This can include running lock-up style film.

6. Angled direction of zipper application (pre- or machine-applied) would allow for larger product access through the zipper.

7. Running machine applied zipper will allow the customer to run zipper packages at lower cost per package.

8. Running machine applied zipper will allow the use of standard size/yield spools of flexible material and zipper.

Thus the several aforementioned objects and advantages are most effectively attained. Although preferred embodiments of the invention have been disclosed and described in detail herein, it should be understood that this invention is in no sense limited thereby.

What is claimed is:

1. A method of producing reclosable packages including the steps of:

providing a spool with a first supply of web or film with zipper material secured thereto;

providing a second supply of web or film, wherein the web or film of the second supply is thermoformable;

feeding the first supply of web with zipper material secured thereto from the spool to a package forming machine;

forming a package from the first supply of web with zipper material secured thereto:

wherein the package, as completed, includes:

a bottom thermoformed tray-shaped wall including a pocket structure, formed from the second supply of web or film;

a top wall, formed from the first supply of web or film, sealed to the bottom thermoformed tray-shaped wall about the periphery thereof;

a frangible element in the top wall;

a zipper, including at least one sealing flange, on an interior of the top wall underneath the frangible element, an entire length of the zipper, including the at least one sealing flange, being free of contact with a seal between material from the first supply of web or film and material from the second supply of web or film, the zipper including first and second zipper profiles and further including a zipper opening flange with an unsealed manually grippable free end extending from one of the first and second zipper profiles adjacent to the top wall, allowing a user to grasp the free end from an exterior of the package and open the zipper to access interior portions of the thermoformed tray-shaped wall.

2. The method of claim 1 further including a peel seal between the zipper opening flange and one of the first and second zipper profiles.

3. The method of claim 1 wherein the zipper material is secured to the first supply of web or film in a machine direction.

4. The method of claim 3 wherein the zipper material is supplied as a continuous length.

5. The method of claim 1 wherein the zipper material is secured to the first supply of web or film in a transverse direction.

6. The method of claim 5 wherein the zipper material is supplied as a series of discrete lengths.

7. The method of claim 5 wherein the zipper material is supplied as a series of discrete lengths.

8. The method of claim 1 wherein the zipper material is secured to the first supply of web or film in an angled orientation, other than a machine direction or a transverse direction.

9. The method of claim 1 wherein the zipper material is secured to the film or web at a location remote from the packaging machine.

10. The method of claim 1 wherein the zipper material is secured to the film or web at a location local to the packaging machine.

* * * * *